US005692670A

United States Patent [19]

Ho

[11] Patent Number: 5,692,670

[45] Date of Patent: Dec. 2, 1997

[54] DOCUMENT FOLDER

[76] Inventor: Chin-Lien Ho, No. 36, Lo-Yang St., Hsi-Tun Dist.., Taichung, Taiwan

[21] Appl. No.: 732,187

[22] Filed: Oct. 17, 1996

Related U.S. Application Data

[63] Continuation-in-part of Ser. No. 669,012, Jun. 24, 1996, Pat. No. 5,639,016.

[51] Int. Cl.[6] ..... B65D 27/00

[52] U.S. Cl. ..... 229/67.1; 229/67.4; 24/67.11

[58] Field of Search ..... 24/67.11, 67.9, 24/67.3; 229/67.1, 67.4

[56] References Cited

U.S. PATENT DOCUMENTS

| | | | |
|---|---|---|---|
| 2,211,034 | 8/1940 | Stern | 24/67.11 |
| 3,099,269 | 7/1963 | Sörensen | 24/67.11 |
| 5,226,676 | 7/1993 | Su | 229/67.1 X |
| 5,285,952 | 2/1994 | Ho | 229/67.4 |

*Primary Examiner*—Jes F. Pascua

*Attorney, Agent, or Firm*—Panitch Schwarze Jacobs & Nadel, P.C.

[57] ABSTRACT

A document folder includes upper and lower sheets, and a C-shaped clamp. The upper and lower sheets have a common edge. The lower sheet has an opening formed adjacent to the common edge. The opening has opposed first and second edges which are parallel to the common edge. The lower sheet further has a plate member connected fixedly to the internal face of the lower sheet in order to cover the opening. The size of the plate member is approximately equal to that of the upper sheet. The plate member is thicker and harder than the upper sheet. The C-shaped clamp has upper and lower clamping plates, and a curved portion. The lower clamping plate has a tapered projection which abuts against the plate member. The C-shaped clamp is movable between a clamping position, where the curved portion of the C-shaped clamp abuts against the common edge and a releasing position, where the shoulder portion of the projection abuts against the first edge of the opening, thereby preventing the C-shaped clamp from being separated from the upper and lower sheets.

3 Claims, 2 Drawing Sheets

DOCUMENT FOLDER

CROSS-REFERENCE OF RELATED APPLICATION

This invention is a continuation-in-part (CIP) application of U.S. patent application Ser. No. 08/669,012, which was filed on Jun. 24, 1996 now U.S. Pat. No. 5,639,016.

BACKGROUND Of THE INVENTION

1. Field of the Invention

This invention relates to a document holder, more particularly to a document folder which has a clamp member for clamping documents, papers, etc. that are received in the document folder.

2. Description of the Related Art

Applicant's U.S. Pat. No. 5,285,952, issued on Feb. 15, 1994, disclosed a document folder which comprises an upper sheet, a lower sheet and an elongated folding portion which interconnects the upper and lower sheets. A C-shaped clamp is provided to clamp the folding portion in order to hold securely the documents, papers, etc. which are received in the document folder. Two parallel silts are formed in the lower sheet adjacent to the folding portion. Two projections extend in opposite direction from the free edge of a lower clamping plate of the C-shaped clamp and are received slidably and respectively in the slits. Since upper and lower sheets of the document folder are usually made of a thin plastic material, they are liable to be bent easily when carried from one place to another place in a soft bag, for example, a hand bag, thereby resulting in crimping or folding of the documents, papers, etc. which are received in the document folder.

SUMMARY OF THE INVENTION

It is therefore a main object of the present invention to provide a document folder which can protect the documents, papers, etc. from being crimped or folded when the document folder is carried from one place to another place in a soft bag.

Accordingly, the document folder of the present invention comprises:

upper and lower sheets having a common edge which interconnects the upper and lower sheets, the lower sheet having an opening formed adjacent to the common edge, the opening having opposed first and second edges which are parallel to the common edge, the first edge of the opening being adjacent to the common edge, the second edge of the opening being distal from the common edge, the lower sheet further having a plate member which is connected fixedly to an internal face of the lower sheet adjacent to the second edge of the opening, the plate member having a size which is substantially equal to that of the upper sheet and an edge which extends adjacent to the common edge so as to cover the opening, said plate member being thicker and harder than the upper sheet; and a C-shaped clamp having upper and lower clamping plates for clamping respectively the upper sheet and the plate member through the opening, and a curved portion which interconnects the upper and lower clamping plates, the lower clamping plate having a tapered projection which projects from a distal edge of the lower clamping plate and which abuts against a lower face of the plate member, the projection having a shoulder portion facing the curved portion, the C-shaped clamp being movable between a clamping position, where the curved portion abuts against the common edge, and a releasing position where the shoulder portion of the projection abuts against the first edge of the opening, thereby preventing the C-shaped clamp from being separated from the upper and lower sheets.

In a preferred embodiment, the lower sheet has two curved slits formed therein. Each of the curved slits extends from a respective one of the opposite ends of the first edge of the opening and has a terminating end which is distal from the common edge. Therefore, the lower sheet can be prevented from being torn along the first edge of the opening when the C-shaped clamp is moved from the clamping position to the releasing position.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
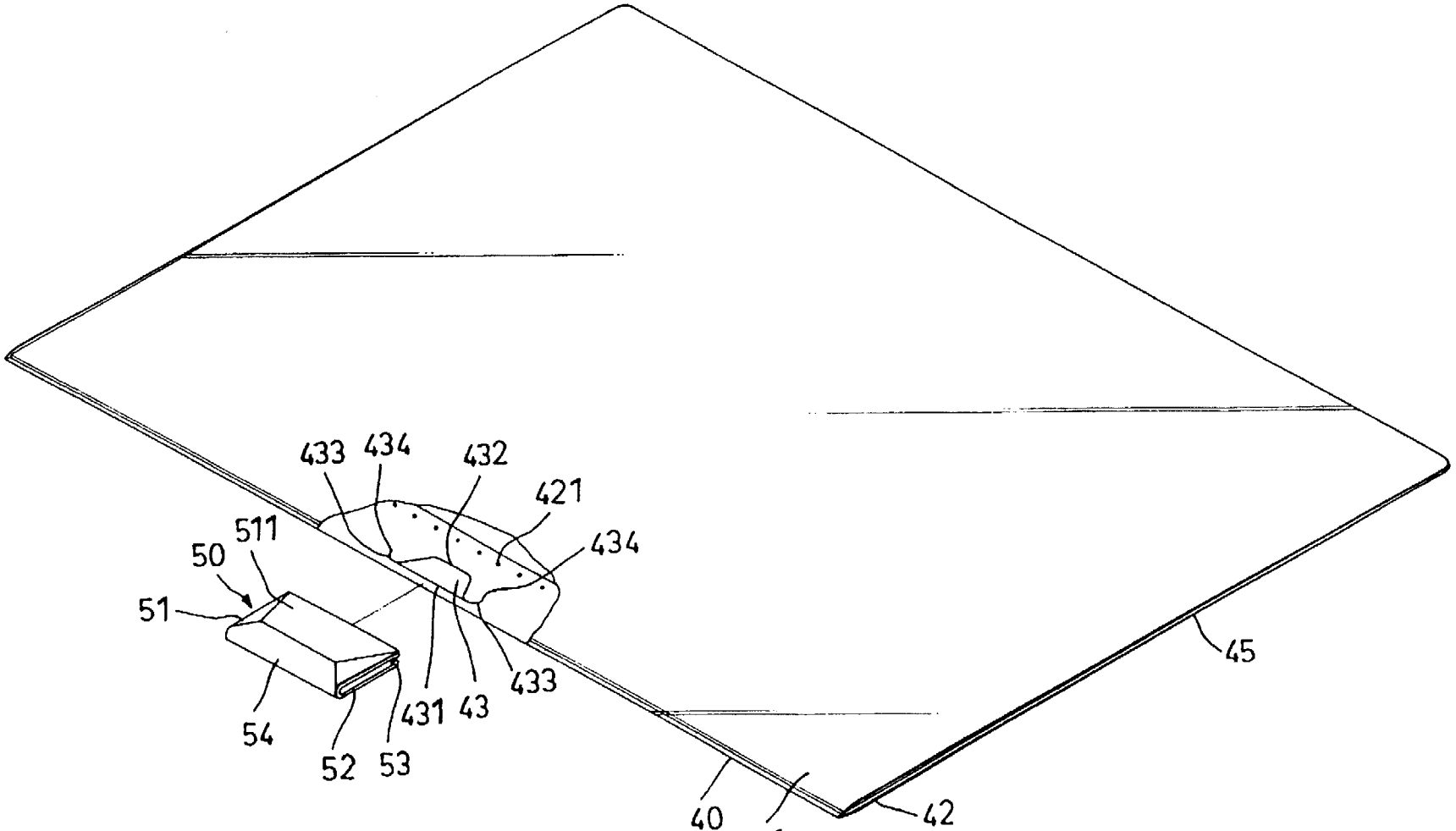
FIG. 1 is an exploded view of a preferred embodiment of a document folder according to the present invention, with a part of the document folder being cut away for clarity.

Referring to FIG. 1, a preferred embodiment of a document folder according to the present invention is shown to comprise an upper sheet 41, a lower sheet 42, and a C-shaped clamp 50.

Figure 2:
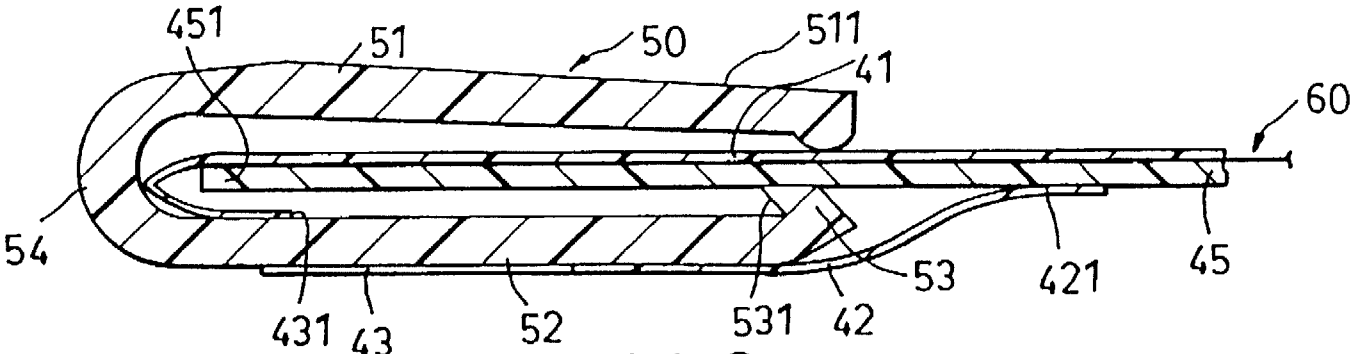
FIG. 2 is a sectional view illustrating the C-shaped clamp of the document folder of the present invention in a clamping position.

Referring to FIGS. 1 and 2, the upper and lower sheets 41, 42 are made of a plastic material. A common edge 40 interconnects the upper and lower sheets 41, 42. The lower sheet 42 has a width which is one-eighth of the width of the upper sheet 41. A generally rectangular opening 43 is formed in the lower sheet 42 adjacent to the common edge 40. The opening 43 has opposed first and second edges 431, 432 which are substantially parallel to the common edge 40. As shown, the first edge 431 is adjacent to the common edge 40 while the second edge 432 is distal from the common edge 40. A rectangular plate member 45 is connected to the internal face of the lower sheet 42 near the distal edge 421 of the lower sheet 42 along the full length of the lower sheet 42. The size of the plate member 45 is approximately equal to that of the upper sheet 41. The plate member 45 has a thickness which is about three times that of the upper sheet 41 so that the plate member 45 is much harder than the upper sheet 41. One edge 451 of the plate member 45 extends adjacent to the common edge 40 in order to cover the opening 43, as best illustrated in FIG. 2. Preferably, the plate member 45 is connected fixedly to distal edge 421 of the lower sheet 42 by means of a high frequency process.

The C-shaped clamp 50 has upper and lower clamping plates 51, 52 which clamp respectively the upper sheet 41 and the plate member 45 through the opening 43, and a curved portion 54. The lower clamping plate 52 has a tapered projection 53 which projects from the distal edge of the lower clamping plate 52 and which abuts against the lower face of the plate member 45. The projection 53 has a shoulder portion 531 which faces the curved portion 54. The C-shaped clamp 50 is movable between a clamping position where the curved portion 54 abuts against the common edge 40, as best illustrating in FIG. 2, and a releasing position where the shoulder portion 531 of the projection 53 abuts against the first edge 431 of the opening 43, as best illustrating in FIG. 3. In the releasing position, engagement between the projection 53 of the C-shaped clamp 50 and the first edge 431 of the opening 43 prevents the C-shaped clamp 50 from being separated from the upper and lower sheets 41, 42. The lower sheet 42 has two curved slits 433 formed therein, as best illustrated in FIG. 1. Each of the curved slits 433 extends from a respective one of the opposed ends of the first edge 431 of the opening 43 and has a terminating end 434 which is distal from the common edge 40 as compared to the opposed ends of the first edge 431. Therefore, the lower sheet 42 can be prevented from being torn along the first edge 431 of the opening 43 when the C-shaped clamp 50 is moved from the clamping position to the releasing position and thereby exerts an impact force on the first edge 431 of the opening 43.

Figure 3:
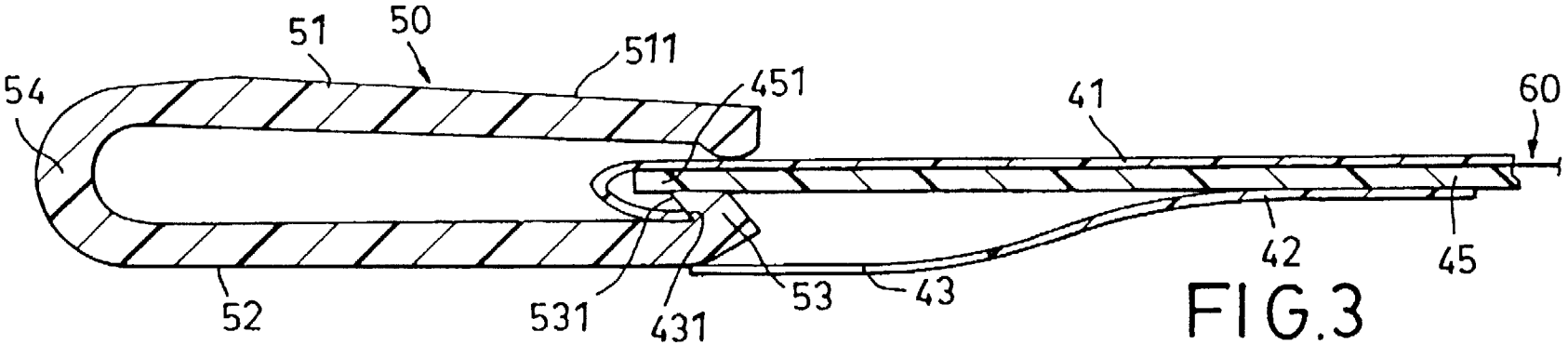
FIG. 3 is a sectional view illustrating the C-shaped clamp of the document folder of the present invention in a releasing position.

In use, the C-shaped clamp 50 is moved to the releasing position, as shown in FIG. 3. A document 60 is inserted between the upper sheet 41 and the plate member 45 until an edge of the document 60 reaches the common edge 40 of the document folder. The C-shaped member 50 is then moved to the clamping position in order to clamp firmly the document 60 between the plate member 45 and the upper sheet 41, as shown in FIG. 2. The document 60 may be withdrawn from the document folder by moving the C-shaped clamp 50 from the clamping position to the releasing position.

The upper clamping plate 51 of the C-shaped clamp 50 has a ramp 511 that inclines downwardly from the intermediate portion of the upper face of the upper clamping plate 51 to the distal edge of the upper clamping plate 51 in order to facilitate grasping of the C-shaped clamp 50 when the C-shaped clamp 50 is moved between the clamping and releasing positions.

It is noted that the plate member 45 is much harder than the upper sheet 41 of the document folder. Therefore, papers, documents, etc. which are clamped between the plate member 45 and the upper sheet 41 can be prevented from being crimped or folded when the document folder is carried from one place to another place in a soft bag. In addition, since the C-shaped clamp 50 will not be in contact with the terminating ends 434, the opening 43 will not be torn easily along the first edge 431 of the opening 43.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A document folder comprising:

upper and lower sheets having a common edge which interconnects said upper and lower sheets, said lower sheet having an opening formed adjacent to said common edge, said opening having opposed first and second edges which are parallel to said common edge, said first edge of said opening having two ends and being adjacent to said common edge, said second edge of said opening being distal from said common edge, said lower sheet further having two curved slits formed therein, each of said curved slits extending from a respective one of said ends of said first edge of said opening and having a terminating end which is distal from said common edge, said lower sheet further having an internal face and a plate member connected to said internal face of said lower sheet, said plate member having a size which is substantially equal to that of said upper sheet and an edge which extends adjacent to said common edge so as to cover said opening, said plate member being thicker and harder than the upper sheet; and a C-shaped clamp having upper and lower clamping plates for clamping respectively said upper sheet and said plate member through said opening, and a curved portion which interconnects said upper and lower clamping plates, said lower clamping plate having a distal edge and a tapered projection which projects from said distal edge of said lower clamping plate and which abuts against said plate member, said projection having a shoulder portion facing said curved portion, said C-shaped clamp being movable between a clamping position, where said curved portion abuts against said common edge and a releasing position, where said shoulder portion of said projection abuts against said first edge of said opening, thereby preventing said C-shaped clamp from being separated from said upper and lower sheets.

2. A document folder as claimed in claim 1, wherein said upper clamping plate of said C-shaped clamp has an upper face, and a ramp which inclines downwardly from an intermediate portion of said upper face to a distal edge of said upper clamping plate.

3. A document folder as claimed in claim 1, wherein said upper and lower sheets are rectangular and said lower sheet has a width which is about one-eighth of the width of said upper sheet, said lower sheet having a distal edge which is connected fixedly to said plate member.

* * * * *